United States Patent [19]

Lindqvist et al.

[11] Patent Number: 4,578,000

[45] Date of Patent: Mar. 25, 1986

[54] METHOD OF PROTECTION

[75] Inventors: Gustav Lindqvist, Espoo; Kimmo Juurmaa, Vantaa, both of Finland

[73] Assignee: Oy Wärtsilä Ab, Helsinki, Finland

[21] Appl. No.: 503,337

[22] Filed: Jun. 10, 1983

[30] Foreign Application Priority Data

Jun. 15, 1982 [FI] Finland ..... 822157

[51] Int. Cl.[4] ..... B63B 35/08; E02B 17/00

[52] U.S. Cl. ..... 405/211; 405/217; 405/61; 114/40

[58] Field of Search ..... 405/217, 61, 211, 195; 114/40, 41

[56] References Cited

U.S. PATENT DOCUMENTS

| | | | |
|---|---|---|---|
| 3,193,260 | 7/1965 | Lamb | 405/61 X |
| 3,324,661 | 6/1967 | Hoglund | 405/61 X |
| 3,669,052 | 6/1972 | Schirtzinger | 114/42 X |
| 3,696,624 | 10/1972 | Bennett | 114/42 X |
| 3,768,264 | 10/1973 | Best | 405/61 |
| 3,807,179 | 4/1974 | Stone | 405/61 |
| 3,932,997 | 1/1976 | Best | 405/61 |
| 4,063,428 | 12/1977 | Waas | 114/40 X |
| 4,073,144 | 2/1978 | Lea | 405/61 |
| 4,102,144 | 7/1978 | Anders | 114/40 X |

*Primary Examiner*—Dennis L. Taylor

*Attorney, Agent, or Firm*—Dellett, Smith-Hill and Bedell

[57] ABSTRACT

A method for protecting stationary constructions, located in water and surrounded by water, against strain caused by a moving ice field in said water. A protective structure is arranged around said stationary construction. Said protective structure has a cross-section considerably greater than the cross-section of said stationary construction and it comprises, at the water surface level and below this level, an outer surface which slopes downwards in a direction against the stationary construction to form an ice breaking surface bending downwards ice, which move against said protective structure.

17 Claims, 2 Drawing Figures

Fig. 1
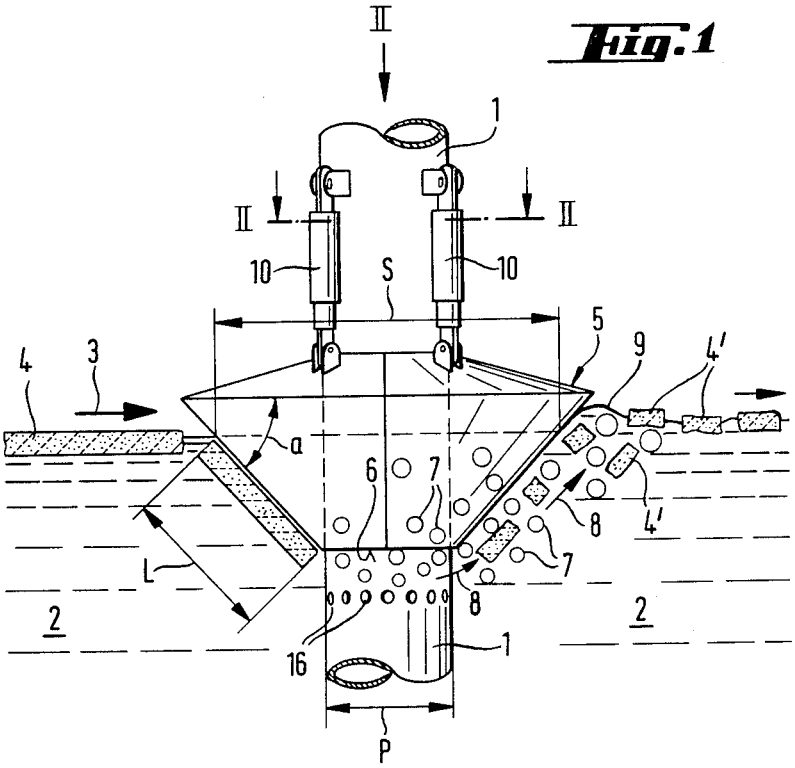
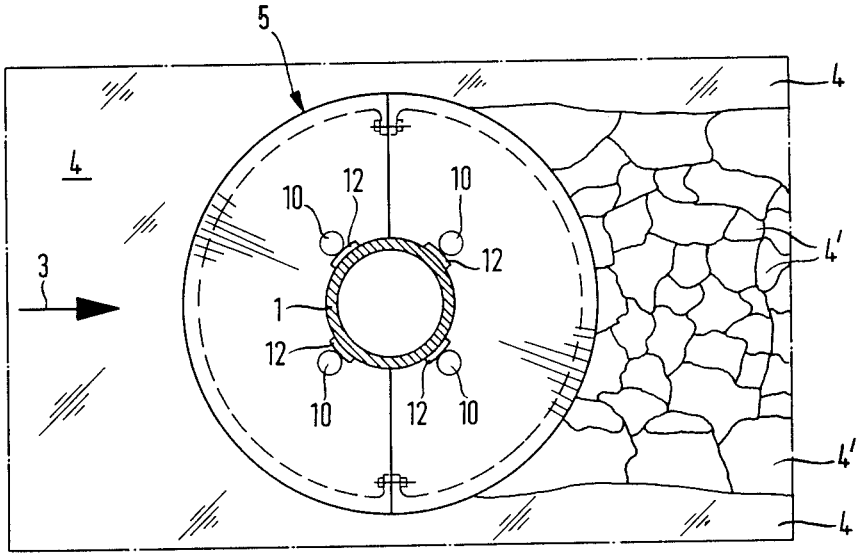
Fig. 2

METHOD OF PROTECTION

The invention relates to a method for protecting stationary constructions, located in water and surrounded by water, against strains from a moving ice field floating on the water surface. In this specification and in the claims, the term "stationary construction" means any construction remaining substantially stationary in water, for instance, an anchored floating construction or the like.

A stationary construction located in water and surrounded by water can be a bridge support pillar, a support pillar of a drilling platform, a light house tower erected on an underwater base, the mast of a wind power station, etc. Constructions of this kind are nowadays frequently used in regions where the water freezes and moving ice fields may occur. The problems caused by ice load can, naturally, best be solved when the entire construction from the beginning is designed to withstand ice pressure. However, this is not possible if a construction designed for open-water conditions is transferred to a region in which ice strain may exist. To redesign a big and complicated structure to withstand ice pressure is a complicated and expensive measure.

The object of the invention is to provide a method, by means of which existing constructions can easily be protected against ice load. The invention is based on the surprising observation, that even though the load caused by a moving ice field, as known, increases proportionally to the icebreaking cross-section area of a stationary construction in said ice field, it is still possible to provide an auxiliary structure which decreases the horizontal load caused by the ice, despite the fact that the cross section area of the entire stationary structure increases, or in other words, the width of the ice field to be broken increases.

In accordance with the invention, a protective structure is arranged around the stationary construction. The protective structure has a crosssection considerably greater than that of the stationary construction, and is formed to have, at the water surface level and below that level, an outer surface which slopes downwards in a direction towards the stationary construction to form an ice breaking surface for bending downwards ice which moves against the protective structure.

A surprisingly extensive decrease of the ice strain is possible, without any alteration of the stationary construction itself, by providing the stationary construction with a protective structure of the kind referred to.

It is observed by calculations, and model tests have shown, that when a stationary construction is broader than the thickness of the ice, the method according to the invention can decrease the horizontal ice load up to about one tenth of the load, that would otherwise occur.

The most uncomplicated way of applying the invention is to form the protective structure as a cone converging downwards. The cone should preferably be so dimensioned and mounted that its diameter at the water surface is 0.8–1.15 times the diameter of the protected stationary construction, divided by $(1-\cos a)$, where a is the inclination angle of the cone mantle surface relative to a horizontal plane. The optimum value of this inclination angle is usually in the range 35°–65°, more precisely expressed, in the range 40°–60°.

Since the strain caused by a moving ice field on a stationary construction essentially depends on the friction between the ice and the stationary construction, it is of advantage, when applying the invention, to make the outer surface of the protective structure smooth at the water surface level and below it. Preferably, a material should be used which remains smooth in sea water for a rather long time. One suitable material is stainless steel, which despite its high price can be the most economic solution. The protective measures according to the invention often bring about savings which exceed by several times the material and labour expenses caused by the application of the invention. A surface of normal steel can also be made smooth by covering it with a special paint, such as epoxi paint, which gives a hard, smooth and ice wear resisting surface.

The efficiency of the method according to the invention can also be improved by blowing pressurized gas through underwater gas blowing openings arranged in the vicinity of the lower end of the protective structure or at a lower level in the stationary construction. When sufficient amounts of gas, for instance air, are blown out, the ascending gas bubbles will cause strong water streams up along the surface of the protective structure, whereby the water acts as a friction decreasing lubricant between the protective structure and the ambient ice. This friction reducing method is described as applied to ships in U.S. Pat. No. 3,580,204, hereby incorporated by reference. This method is different from the similar known method, which is used to raise warm bottom water to the surface by means of upstreaming air bubbles for melting the ice located at the water surface or for preventing ice formation. When using the gas blowing method according to the invention, the amount of gas blown out into the water must be so great, that the water stream generated can clearly be observed in the form of a water ridge at the water surface in the immediately vicinity of the protective structure. This ridge is best observed when operating the device in open water not disturbed by waves or the like.

It has been found favourable that the protective structure is so dimensioned and mounted that the vertical extension of its downwards sloping portion, from the water surface level downwards, is at least twice the thickness of the thickest level ice occurring in the area in question, preferably about four times said thickness.

The invention will now be discribed, by way of example, with reference to the accompanying drawing, wherein FIG. 1 is a schematical side view of an application of the method according to the invention for protecting a stationary vertical column, FIG. 2 shows a top view of the arrangement of FIG. 1.

In the drawing, numeral 1 refers to a stationary vertical tube column, the lower portion of which is located in water 2, which is covered by an ice field 4 moving in the direction of the arrow 3. An ice field of this kind, moving due to wind or current, must be broken up into pieces 4' when it passes a stationary object, such as column 1. This causes a horizontal load acting on the stationary column 1, which load may be quite strong and cause a bow, a break or a displacement of the column. Attempts have been made to solve this problem by giving the column a favourable shape minimizing the ice load. This is complicated, and usually it will unfavourably affect the unit of which the column is a part. It is also possible to dimension the column to withstand the ice load, but then its diameter increases considerably, which in turn causes an increasing ice load, etc. A third possible way is to prevent the ice formation in the vicinity of the column, which requires great amounts of energy. Moreover, the known methods for preventing ice formation are usually not effective in a moving ice field.

Column 1 can be, for instance, a hollow steel column with a circular cross section. According to the invention, a protective structure 5 is mounted around column 1. Thereby a cross section affected by ice load is considerably increased, but in spite of this a considerable reduction of the horizontal ice load is obtained. The most uncomplicated shape of the protective structure 5 is a downwards converging smooth surface cone. The cone is so dimensioned that the ice pieces will not directly collide with column 1. Since the greatest length of an ice piece broken by the cone 5 is one half of the diameter of the cone at the water level, the cone side line length L, from the water surface level to lower edge 6 of the cone, is so selected that it is one half of the diameter S of the cone 5 at the water surface level.

In the following, reference is made to the quantities defined 1 below:

S=diameter of cone 5 at the water surface level

P=diameter of column 1 a=inclination angle of the outer surface of cone 5, relative to a horizontal plane t=bending strength of ice, about 500 kN/m$^2$ h=ice thickness in meters H=horizontal load caused by ice when broken by bending M=horizontal load caused by ice when broken by crushing c=crushing strength of ice, 3000 . . . 7000 kN/m$^2$ f=form coefficient n=ice buoyancy, about 9 kN/m$^3$ The object of the protective structure is to break the ice by bending it downwards. The horizontal load acting on cone 5 due to the ice can roughly be calculated according to the known resistance equation of Kashteljan:

$$H=0.004\cdot S\cdot t\cdot h\cdot f+3.6\cdot n\cdot S\cdot h^2\cdot f \quad (1)$$

The form coefficient for a cone is $$f=1+0.5\tan a$$

If a protective structure according to the invention is not used, the ice 4 collides directly with column 1, which leads to ice breaking by crushing. The load caused by the ice can then be calculated according to the following equation:

$$M=0.5\cdot c\cdot h\cdot P$$

The Kashteljan resistance equation (1) gives somewhat misleading results. It gives, for instance, an optimum value of 67° for the angle a. More precise and far more complicated calculations have shown that the real optimum of the angle a is about 50° and that in practice angle a should be between 35° and 65°, preferably between 40° and 60°.

In a case, where the ice thickness is 1 meter and the diameter of column 1 8 meters, the ice load will be about 110 tons if a favourable value is chosen for the angle a. Without the protective structure 5, in a similar situation, the horizontal load caused by the ice and acting on column 1 may rise to a value of 2800 tons. Thus, the resistance can, by means of the invention, be so much reduced that it is only about 4% of the load otherwise acting on column 1. Even in case the protective structure is not dimensioned and formed in the most favourable way, one can nevertheless assume that the actual ice load is of the magnitude of 10% of the load which would act on the stationary construction if no protective structure according to the invention is used.

It is also shown in the drawing how the friction caused by ice can be decreased by the air blowing method described above. At a rather deep level air large amounts of air is blow from openings 16. The air as such does not have any significant effect on the ice friction, but the ascending air bubbles 7 will generate strong upwards water streams 8 generating a water ridge 9 at the water surface in the immediately vicinity of cone 5. The height of the ridge 9 can be about 20 cm in calm open-water, or even considerably more. A recommended depth level of the air blow openings is about 5 m, and the recommended outblow pressure only slightly exceeds the hydrostatic pressure existing at the depth of the openings 16.

In very severe ice conditions a vertically movable protective structure can be used. Its mobility can be obtained by means of power cylinders 10. Four such cylinders can be used, as shown in FIG. 2. Suitable guide and sliding surfaces 12 should be arranged for the vertically movable protective structure. Ice breaking can be effected by means of moving the structure 5 downwards. By this means even ice ridges can be scattered in order to decrease the load acting on column 1.

The invention is not limited to the embodiments shown, but several modifications thereof are feasible within the scope of the attached claims.

We claim:

1. A method for protecting a stationary construction located in water and surrounded thereby, against strain caused by a moving ice field in said water, said method comprising:

providing a protective structure having a cross-section considerably greater than the cross-section of said stationary construction and being formed to have a sloping outer surface;

arranging the protective structure around said stationary construction so that said sloping surface slopes downwards towards said stationary construction and is located at the water surface level and extends below the water surface level, to form an ice breaking surface which bends downwards ice moving against said protective structure; and maintaining the protective structure normally in a rigid and fixed relationship with respect to the stationary construction, so as to take up upwardly directed reaction forces provided by the ice.

2. A method according to claim 1, comprising blowing gas under pressure into the water at a level at least as low as the lower portion of the protective structure, to provide water streams over the outer surface of the protective structure and thereby reduce friction between the protective structure and the ambient ice.

3. A method according to claim 1, in which said protective structure (5) is basically formed as a downwards converging cone.

4. A method according to claim 3, in which said protective structure is so dimensioned and mounted that its diameter at the water surface level is 0.8–1.5 times the diameter of said stationary construction divided by (1−cos a,) where a is the inclination angle of said cone surface relative to a horizontal plane.

5. A method according to claim 1, in which said protective structure is so shaped, that the inclination of its outer surface relative to a horizontal plane is 35°–65°.

6. A method according to claims 1, in which the outer surface of said protective structure, at the water surface level and below this level, is smooth.

7. A method according to claims 1, in which said protective structure is so dimensioned and mounted, that the vertical extension of its downwards sloping portion, from the water surface level downwards, is at least twice the thickness of the thickest level ice occurring in the area where said stationary construction is located, preferably about four times said ice thickness.

8. A method according to claim 1, wherein the protective structure closely surrounds the stationary construction.

9. In combination, a stationary construction located in water and surrounded thereby, a protective structure for protecting the stationary construction against strain caused by a moving ice field in the water, and mounting means for maintaining the protective structure normally in a fixed and rigid relationship with respect to the stationary construction, the protective structure being arranged around the stationary construction and having, at the water surface level and below that level, an outer surface which slopes downwardly in a direction towards the stationary construction to form an ice breaking surface for bending downwards ice moving against the protective structure.

10. A combination according to claim 9, in which the protective structure is formed as a downwards converging cone having a diameter, at the water surface level, of substantially 0.8 to 1.5 times the diameter of said stationary construction divided by $(1-\cos a)$ where a is the angle of inclination of the cone's surface relative to a horizontal plane.

11. A combination according to claim 9, in which the outer surface of the protective structure is inclined at an angle of substantially 35° to 65° to a horizontal plane.

12. A method according to claim 5, wherein the outer surface of the protective structure is inclined at an angle of substantially 40° to 60° to a horizontal plane.

13. A method according to claim 6, wherein the outer surface of said protective structure is made from a material which remains smooth in sea water.

14. A combination according to claim 9, wherein the mounting means are operable under abnormal conditions to urge the protective structure downwards.

15. A combination according to claim 9, wherein the protective structure closely surrounds the stationary construction.

16. A combination according to claim 15, wherein the stationary construction is an essentially cylindrical column and the protective structure is formed as a downwards converging cone having a central opening through which the column extends in substantially coaxial relationship with the protective structure.

17. A method according to claim 8, wherein the stationary construction is an essentially cylindrical column and the protective structure is formed as a downwards converging cone having a central opening through which the column extends in substantially coaxial relationship with the protective structure.

* * * * *